United States Patent [19]

Evers et al.

[11] Patent Number: 4,923,059

[45] Date of Patent: May 8, 1990

[54] HINGED TOP CIGARETTE BOX

[75] Inventors: Donald H. Evers; Xuan M. Pham, both of Richmond, Va.

[73] Assignee: Philip Morris Incorporated, New York, N.Y.

[21] Appl. No.: 387,835

[22] Filed: Aug. 1, 1989

[51] Int. Cl.[5] ..... A24F 15/00

[52] U.S. Cl. ..... 206/265; 206/270; 206/261; 206/204; 229/125.08; 229/125.17

[58] Field of Search ..... 206/261, 265, 268, 270, 206/271, 273, 204; 229/125.01, 125.08, 125.17

[56] References Cited

U.S. PATENT DOCUMENTS

| | | | |
|---|---|---|---|
| 1,278,691 | 9/1918 | Leiman . | |
| 1,532,831 | 4/1925 | Mastin . | |
| 2,085,600 | 6/1937 | Petersen . | |
| 2,272,203 | 2/1942 | Hothersall . | |
| 2,320,289 | 5/1943 | Marx | 206/268 |
| 2,396,150 | 3/1946 | Bonville . | |
| 2,522,952 | 9/1950 | Krohn | 206/204 |
| 2,661,139 | 12/1953 | Brooks | 229/125.08 |
| 3,437,257 | 4/1969 | Bua | 229/125.17 |
| 3,708,108 | 1/1973 | Rosenburg, Jr. . | |
| 3,858,788 | 1/1975 | Philips, Jr. . | |
| 3,929,271 | 12/1975 | Meyers . | |
| 4,183,457 | 1/1980 | Loughley et al. | 229/125.17 |
| 4,267,926 | 5/1981 | Toimil | 206/268 |
| 4,281,761 | 8/1981 | Olazabal | 206/268 |
| 4,287,995 | 9/1981 | Moriya . | |
| 4,421,235 | 12/1983 | Moriya . | |
| 4,444,308 | 4/1984 | MacEwen . | |
| 4,834,234 | 5/1989 | Sacherer et al. | 206/204 |

FOREIGN PATENT DOCUMENTS

| | | | |
|---|---|---|---|
| 801564 | 7/1949 | Fed. Rep. of Germany . | |
| 206396 | 11/1923 | United Kingdom . | |
| 920354 | 3/1963 | United Kingdom . | |
| 1559807 | 1/1980 | United Kingdom | 206/273 |

*Primary Examiner*—David T. Fidei
*Attorney, Agent, or Firm*—Eric M. Lee

[57] ABSTRACT

A hinged top cigarette box is provided. The box has an inner sleeve nested inside an outer sleeve. Preferably both the inner sleeve member and the outer sleeve member are formed from the same laminate blank. The outer sleeve member has a cover member formed therein. The cover member opens and closes by the use of a flexural hinge. Alternatively, the hinged top box can be formed by separate laminate blanks. Plugs may be used to close the top and bottom portion of the hinged top box to hold the shape of the hinged top box and to prevent cigarettes or loose tobacco from falling therethrough.

13 Claims, 6 Drawing Sheets

FIG. 1
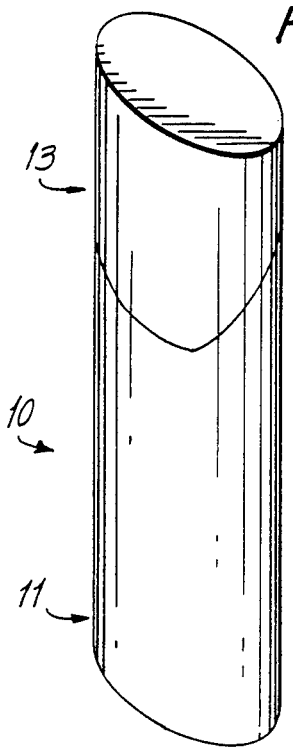
FIG. 2
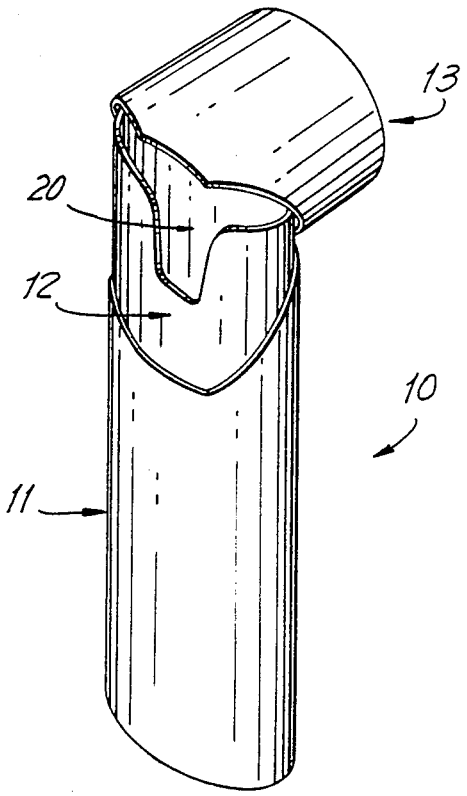
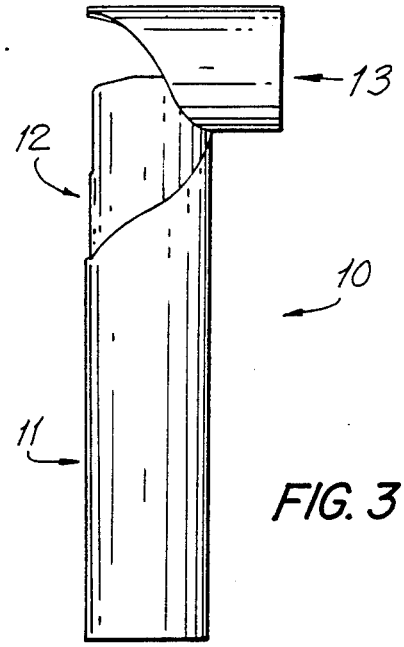
FIG. 3

15"

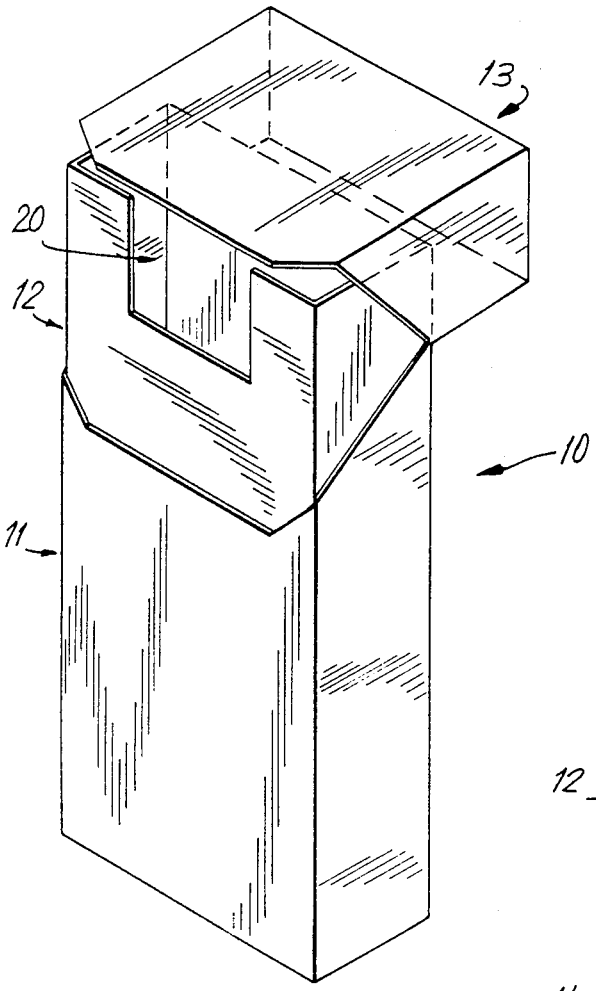
FIG. 6
FIG. 7
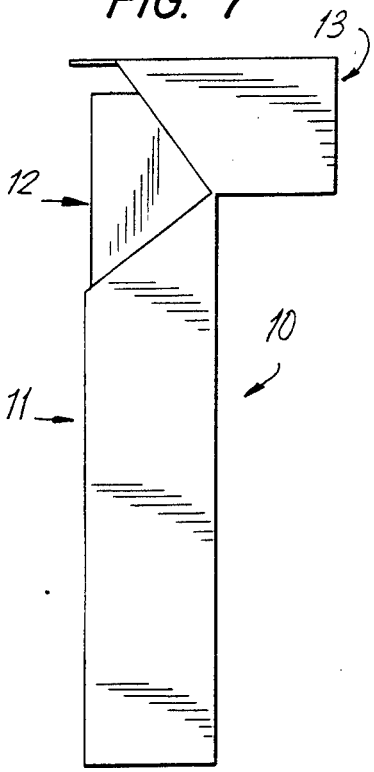

FIG. 9
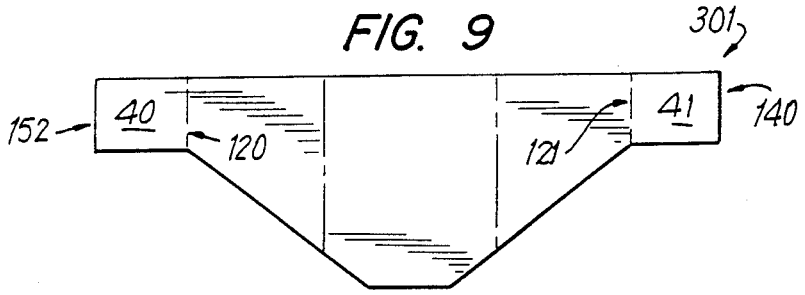
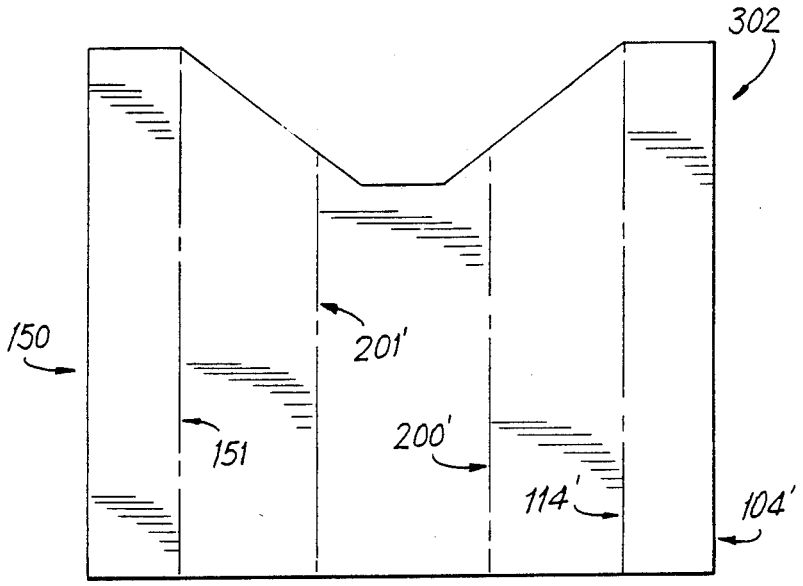
FIG. 10
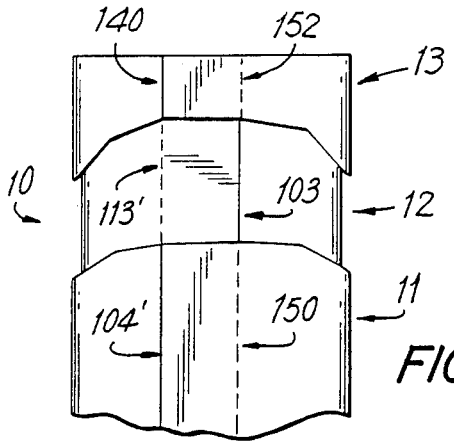
FIG. 11

HINGED TOP CIGARETTE BOX

BACKGROUND OF THE INVENTION

This invention relates to cigarette packs, and particularly to a hinged top box for cigarettes.

Cigarettes are typically sold in packs of twenty to twenty-five cigarettes. Two types of packs are in general use. The first type is a soft pack which is a bundle of cigarettes wrapped in foil, overwrapped with a paper which usually has brand and other information printed on its outer side, and overwrapped again with a sealed polypropylene layer. The second type is a box which is a hard, paperboard box containing a foil wrapped cigarette bundle and having a hinged lid at the top. Typically, a paper-board insert surrounds the bundle at least near the top of the box providing a frictional engagement surface to retain the lid in the closed position when desired. A cutout in this insert allows a smoker to remove cigarettes from the box. This second type of pack is also overwrapped with a sealed polypropylene layer.

Each type of pack has its own advantages and disadvantages. The soft pack has soft corners, and collapses as cigarettes are removed from it, taking up less space in a smoker's pocket or purse as the contents are smoked, while providing an approximate external indication of the number of cigarettes remaining in the pack. However, once the polypropylene wrapper of a soft pack is opened, it cannot be resealed. As a result, cigarettes or any loose tobacco in the pack may eventually drop from the pack into the smoker's pocket or purse. The cigarettes can also be damaged if the pack is roughly handled. For these reasons, many smokers prefer a hinged top box, which can be reclosed to prevent loose tobacco from dropping out, and which offers better protection for the cigarettes within it. However, the typical cigarette hinged top box has hard corners which are necessary for the box to hold its shape. In addition, current hinged top box designs only allow for an angular shape profile and generally have imperfect miter alignment between the top and the body.

SUMMARY OF THE INVENTION

It is an object of the invention to provide a cigarette pack which will prevent the dropping out of cigarettes or loose tobacco.

It is another object of the invention to provide a cigarette pack of increased attractiveness to smokers.

It is yet another object of the invention to provide a cigarette pack having a rounded profile or other unique shape.

It is still another object of the invention to provide a cigarette pack that does not have hard corners and still holds its shape.

It is a further object of the invention to provide a cigarette pack that has perfect miter alignment between the top and the body.

It is yet a further object of the invention to provide a hinged top cigarette box wherein the hinge for the top is hidden from view.

In accordance with the invention, a hinged top box is provided having an inner sleeve member nested inside an outer sleeve member and having a cover member that opens and closes to allow access to the cigarettes. A plug is used to cap either or both ends of the hinged top box thus formed. The plug also helps the hinged top box retain the proper cross-sectional shape and prevents cigarettes or loose tobacco from falling out of the hinged top box.

Preferably the inner sleeve member, the outer sleeve member and the cover member are formed from the same laminate blank. The inner sleeve member has a height substantially the length of a cigarette, a width approximately equal to an integral multiple of the diameter of a cigarette and a depth sufficient to accommodate a plurality of rows of cigarettes. A cutout through which cigarettes may be withdrawn is provided in the top and forward portion of the inner sleeve member. The outer sleeve member is cut substantially across its width near the top thereof and is scored from both ends of the cut to the ends of the outer sleeve member. This configuration provides a cover member at the top of and hingedly connected to the outer sleeve member. The outer sleeve member is positioned so the cover member reveals the cutout portion of the inner sleeve member when the cover member is swung away from the inner sleeve member. This allows easy access to the cigarettes stored in the hinged top box. The height of the outer sleeve member with the cover member formed therein is preferably greater than the length of a cigarette.

Alternatively, the hinged top box may be formed from separate laminate blanks. For example, three blanks may be used, one for the inner sleeve member, one for the outer sleeve member, and one for the cover member. In this embodiment, the cover member is preferably adhered to a flexible tab at the top and rear portion of the inner sleeve member. In this way, when the inner sleeve member is nested inside the outer sleeve member, the hinge for the cover member is preferably hidden from view presenting an attractive appearance to the smoker.

Of course, the hinged top box may also be formed from two blanks. One for the inner sleeve member and one for both the outer sleeve member and cover member.

In all of these embodiments, the hinged top box may have any cross-sectional shape such as a polygon or a circle or an oval. An arcuate cross-section avoids the hard square edges of typical hinged top cigarette boxes and presents a more pleasing appearance to the smoker. The cross-sectional shape of the hinged top box is limited only by the shape of the mandrel that is used for forming the laminate blank into the desired shape.

BRIEF DESCRIPTION OF THE DRAWINGS

The above and other objects and advantages of the invention will be apparent from consideration of the following detailed description, taken in conjunction with the accompanying drawings in which like reference characters refer to like parts throughout and in which:

FIG. 1 is a perspective view of the preferred embodiment of the hinged top box of the invention in the closed position;

FIG. 2 is a perspective view of the preferred embodiment of the hinged top box of the invention in the open position;

FIG. 3 is a side elevational view of the preferred embodiment of the hinged top box of the invention in the open position;

FIG. 6 is a perspective view of the second embodiment of the hinged top box of the invention in the open position;

FIG. 7 is a side elevational view of the second embodiment of the hinged top box of the invention in the open position;

FIG. 9 is a plan view of a blank for the cover member for the hinged top box of the invention;

FIG. 10 is a plan view of a blank for the outer sleeve member for the hinged top box of the invention; and FIG. 11 is a rear elevational view of the hinged top box of the invention made from three separate blanks with the inner sleeve member pulled slightly out of the outer sleeve member for clarity.

DETAILED DESCRIPTION OF THE INVENTION

Figure 3A:
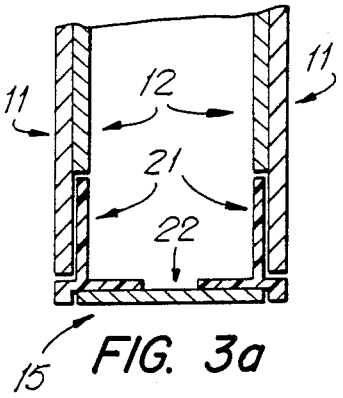
FIG. 3*a* is a cross-sectional view of an end of the hinged top box showing one embodiment of the plug of the invention.

A preferred embodiment of the hinged top box of the present invention is shown in FIGS. 1–3. In the preferred embodiment, hinged top box 10 has an oval cross-section. This configuration avoids the hard square edges of typical hinged top cigarette boxes. Hinged top box 10 includes an outer sleeve member 11, an inner sleeve member 12 and a cover member 13. Inner sleeve member 12 is nested inside outer sleeve member 11 and has a cutout 20 to facilitate the removal of cigarettes from hinged top box 10. Preferably, inner sleeve member 12 has a height substantially equal to the length of a cigarette. The combined height of outer sleeve member 11 and cover member 13 is preferably greater than the length of a cigarette. This difference in height allows a plug 15 to be inserted into the bottom of outer sleeve member 11 and into the top of cover member 13 to enclose hinged top box 10 when cover member 13 is closed. Cover member 13 is hingedly connected to outer sleeve member 11 to allow access to the cigarettes stored in hinged top box 10 and to close hinged top box 10.

Plug 15 may be inserted into and adhered by glue or other standard means to the top or bottom of hinged top box 10 to prevent loose tobacco or cigarettes from falling out of hinged top box 10 and to hold the shape of hinged top box 10. Plug 15 may be a single plastic or laminate material insert or it may be a multiple piece device.

For example, as shown in FIG. 3*a*, a laminate disk 22 may be attached to a member 21 which fits in outer sleeve member 11. Perforations may be placed in disk 22 to eliminate the hydraulic effect caused by loading a plurality of cigarettes into hinged top box 10, i.e. the holes minimize the back pressure that may result if the cigarettes are loaded into hinged top box 10 too quickly. The perforations also act as a means by which the hinged top box may be oriented properly for insertion of the cigarettes. A plug of similar configuration (not shown) may be inserted into the top of cover member 13.

Figure 3B:
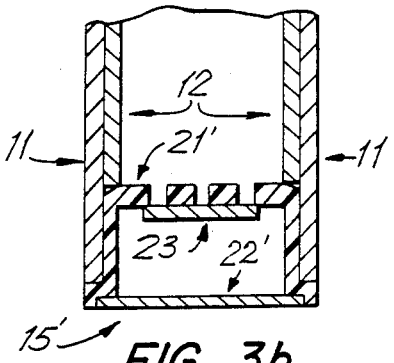
FIG. 3*b* is a cross-sectional view of an end of the hinged top box showing another embodiment of the plug of the invention.

In an alternative embodiment shown in FIG. 3*b*, plug 15' is comprised of a member 21' combined with disk 22' defining a space therebetween. This space may be filled with material that transfers moisture, flavor or odor to the cigarettes stored in hinged top box 10. Member 21' may be perforated. This allows fluid transfer between the space formed in plug 15' and the cigarettes stored in hinged top box 10. The perforations also help eliminate back pressure. A permeable membrane 23 may be placed over the perforations in member 21' to control the fluid transfer between the cigarettes and the material placed in plug 15'. The invention described in copending U.S. patent application Ser. No. 07/254,566 filed Oct. 7, 1988 describes a device for controlling the relative humidity in a substantially sealed container such as a pack of cigarettes that is suitable for use in plug 15'.

Figure 3C:
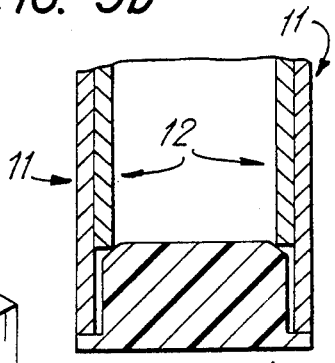
FIG. 3*c* is a cross-sectional view of an end of the hinged top box showing still another embodiment of the plug of the invention.

A preferred embodiment is shown in FIG. 3*c*. Plug 15'' is formed of one piece and is tapered at its upper end to allow for ease of entry into outer member 11 or cover member 13. This taper also provides an area for excess glue, used to secure plug 15'' in place, to be deposited.

Preferably, outer sleeve member 11, inner sleeve member 12 and cover member 13 are all formed from the same laminate blank 100. Laminate blank 100 is formed over a mandrel and may have as many plies as desired. Preferably two plies are used. The laminate blanks, from which the hinged top box of this invention is made, are typically standard paperboard used for conventional cigarette hinged top boxes.

Figure 4:
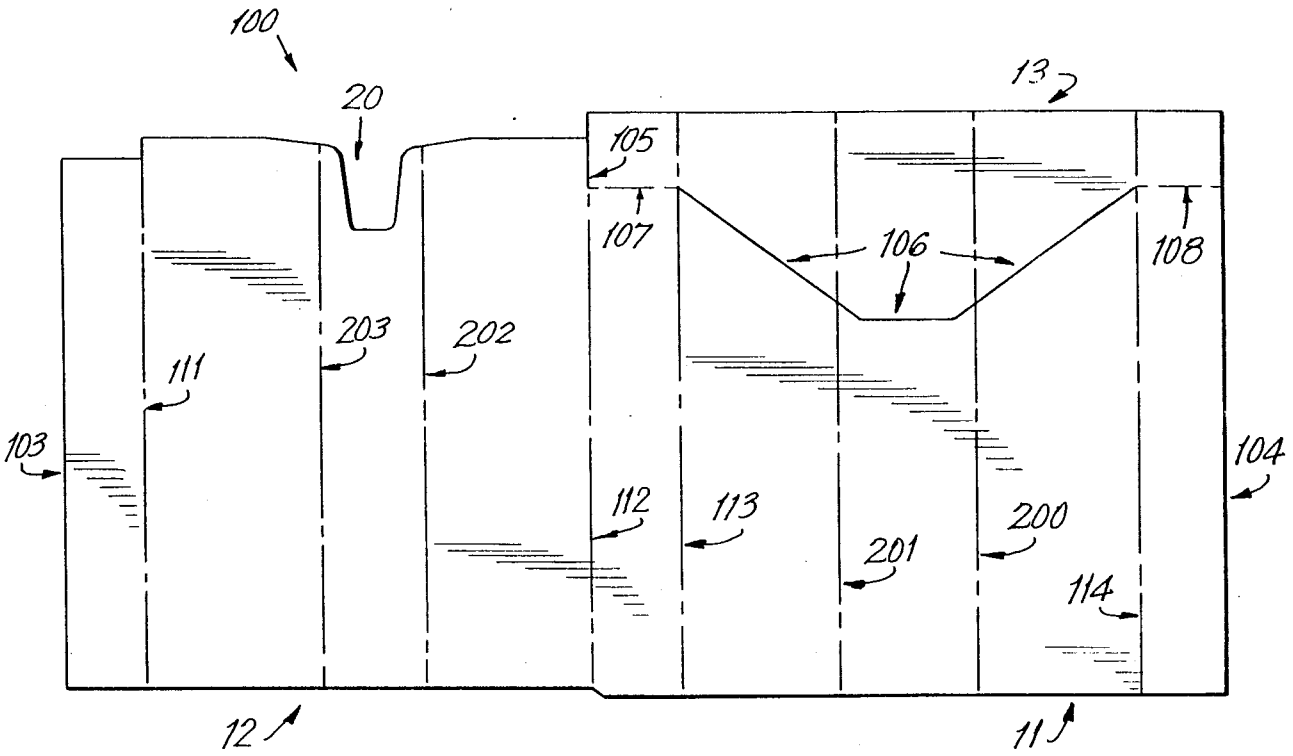
FIG. 4 is a plan view of the one piece blank for the hinged top box of the invention.

Inner sleeve member 12 of laminate blank 100 is defined by edge 103 and line 112. As shown in FIG. 4, inner sleeve member 12 has a height that is less than the combined height of cover member 13 and outer sleeve member 11. Preferably inner sleeve member 12 is ribbed to weaken the blank which facilitates folding thereof. Outer sleeve member 11 is defined by edge 104 and line 112. Outer sleeve member 11 may be ribbed or otherwise decorated or labeled with brand or other information on the side that will be exposed to the smoker. Cut lines 105 and 106 and score lines 107 and 108 define cover member 13. Score line 107 is preferably also perforated to further weaken that line. Of course, cut line 106 could have any configuration, such as an arcuate line. When laminate blank 100 is folded to form hinged top box 10, score lines 107 and 108 overlap to form the hinge about which cover member 13 rotates. Cut line 105 allows a hinging action for cover member 13. Preferably cut line 105 extends below score line 107 a short distance to facilitate the hinging action of cover member 13. This distance is preferably about one millimeter. Cut line 106 forms the opening through which access to the cigarettes is made available.

Hinged top box 10 is formed by folding laminate blank 100 appropriately. Edge 103 is wrapped in either a clockwise direction or a counter clockwise direction until it abuts with line 112. Edge 104 is then wrapped over edge 103 until it abuts with line 113. Preferably edge 104 is wrapped over edge 103 in a direction counter to that in which edge 103 is wrapped. The direction of rotation of edge 103 depends on which side of outer sleeve member 11 of laminate blank 100 is to be viewed by the smoker. That portion of laminate blank 100 bounded by line 111 and edge 103 is adhered to that portion of laminate blank 100 bounded by line 113 and line 112. The adherence may be achieved by any conventional means of joining layers of standard paperboard. For example, a hot melt or liquid adhesive may be used or the paperboard may be coated and joined to an adjacent paperboard by heat or ultra sonic vibrations Edge 104 is preferably wrapped over edge 103 until it abuts with line 113 so that score lines 107 and 108 overlap. The portion of laminate blank 100 bounded by edge 104 and line 114 is adhered to the portion of laminate blank 100 bounded by line 112 and line 113. Also the portion of laminate blank 100 bounded by lines 202 and 203 is preferably adhered to the portion of outer member 11 bounded by lines 200 and 201. With hinged top box 10 thus formed, cover member 13 is hinged along the overlap of score lines 107 and 108. When cover member 13 is rotated away from inner sleeve member 12, cutout 20 is exposed allowing access to the cigarettes stored in hinged top box 10.

Figure 5:
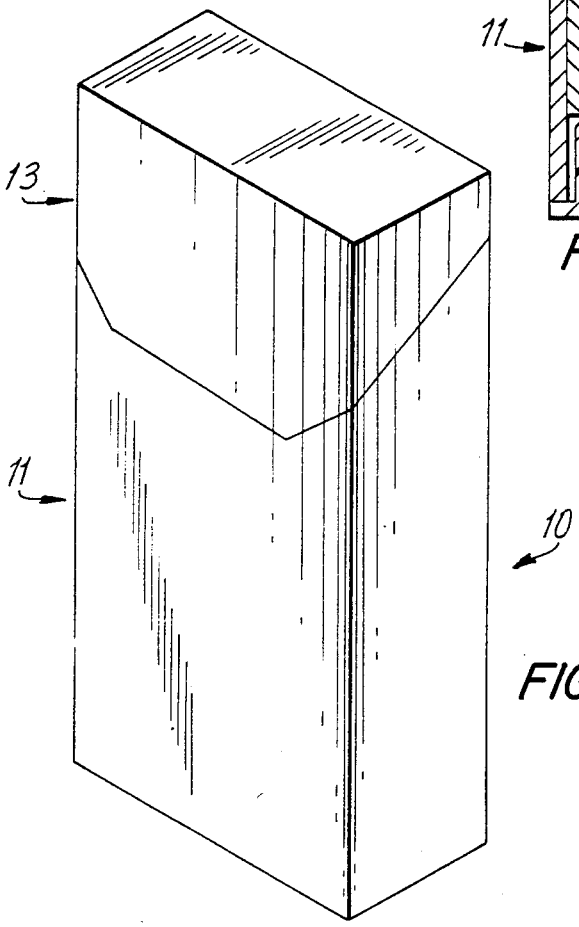
FIG. 5 is a perspective view of a second embodiment of the hinged top box of the invention in the closed position.

Hinged top box 10 also may be folded to have any other cross-sectional shape such as a substantially rectangular or other polygonal cross-section such as shown in FIGS. 5–7.

Figure 8:
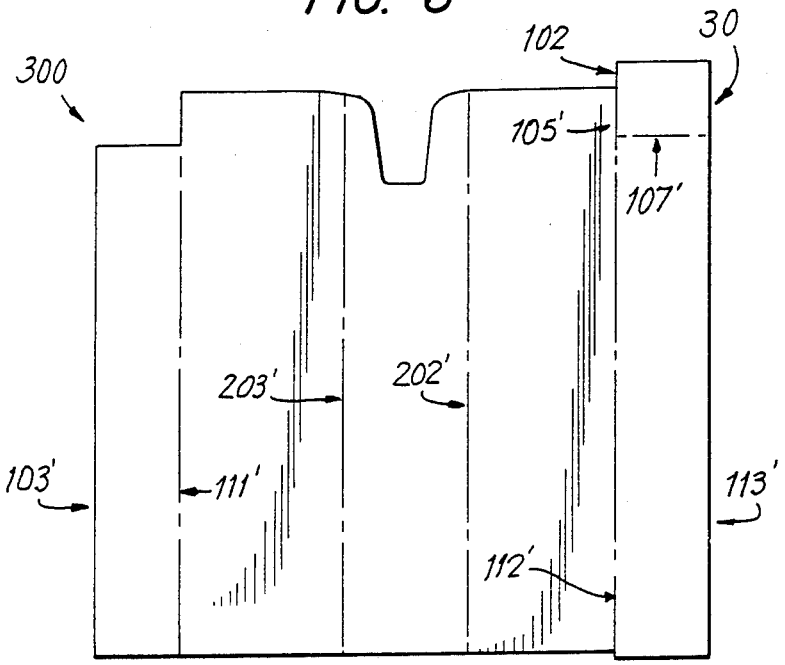
FIG. 8 is a plan view of a blank for the inner sleeve member for the hinged top box of the invention.

Hinged top box 10 may also be formed from separate laminate blanks. For example, three laminate blanks may be used. The laminate blank 300 which is folded into inner sleeve member 12 may be formed by cutting laminate blank 100 along line 113. Thus laminate blank 300 has the shape shown in FIG. 8. Inner sleeve member 12 may be formed by folding edge 103' clockwise or counterclockwise until it abuts with line 112'. The portion of laminate blank 300 bounded by edge 103' and line 111' may be adhered to the portion of laminate blank 300 bounded by line 112' and edge 113'. The tab 30 formed by edge 102 and 113', cut line 105' and score line 107' hinges about score line 107'. Tab 30 thus forms the hinge on which cover member 13 may be adhered. As discussed previously, cut line 105' extends slightly below score line 107'. Score line 107' is also preferably perforated to faciliate the hinging action of tab 30.

The laminate blank 302 for outer sleeve member 11 may be formed by cutting laminate blank 100 along lines 112, 105, 106, 107, and 108 to have the shape shown in FIG. 10. Outer sleeve member 11 may be formed by folding edge 150 clockwise or counterclockwise so that it abuts with line 114'. The direction that edge 150 is folded depends on which side of laminate blank 302 is to be viewed by the smoker. The portion of laminate blank 302 bounded by edge 150 and line 151 is adhered to that portion of laminate blank 302 bounded by edge 104' and line 114'.

The laminate blank 301 for cover member 13 may be formed by cutting another laminate blank 100 along lines 105, 106, 107, and 108 to have the shape shown in FIG. 9. Cover member 13 may be formed by folding edge 152 clockwise or counterclockwise so that it abuts with line 121. The direction that cover member 13 is folded depends on which side of laminate blank 301 is to be viewed by the smoker. The tab portion 40 of laminate blank 301 bounded by edge 152 and line 120 may be adhered to the tab portion 41 of laminate blank 301 bounded by edge 140 and line 121. Overlapping tab portions 40 and 41 may be adhered to the tab 30 of inner sleeve member 12 formed from laminate blank 300. In this manner, when inner sleeve member 12 is inserted into outer sleeve member 11 formed from laminate blank 302, the hinge for member 13 is hidden from view. The area of inner sleeve member 12 bounded by lines 202' and 203' is preferably adhered to the area of outer sleeve member 11 bounded by lines 200' and 201'.

Of course hinged top box may also be formed from two laminate blanks. Laminate blank 100 may be cut along line 112 to form one laminate blank for cover member 13 and outer member 11, the other portion being discarded. Another laminate blank 100 can then be cut along line 112 or 113 to form inner member 12, the other portion being discarded. These two blanks can then be folded and joined as described above to form hinged top box 10.

The hinged top box described herein provides a hinged top box that prevents the dropping out of cigarettes or loose tobacco, has an attractive appearance and holds its shape, has a perfect miter alignment between the top and body and has a hinge hidden from view. In addition, the perfect miter alignment allows for better graphic alignment between the top and the body. Finally, by using an oval shape for the hinged top box, less paperboard is needed than for conventional hinged top boxes.

It will be apparent to those skilled in the art that the invention described herein can be practiced by other than the embodiments described above, which are presented for the purposes of illustration and not of limitation, and the present invention is limited only by the claims which follow.

What is claimed is:

1. A hinged top box comprising:

an inner sleeve formed from a laminate blank having a first panel and a second panel;

an outer sleeve formed from said laminate blank surrounding said inner sleeve;

a cover member formed from said laminate blank and connected to said outer sleeve by a flexural hinge;

said first panel forming said inner sleeve defined by a first edge of said laminate blank and a short cut line parallel to said first edge at an intermediate position along the width of said laminate blank;

said second panel forming said outer sleeve and said cover member defined by a second edge of said laminate blank, parallel to said first edge and said short cut line, said second panel having a first short score line positioned at the end of said short cut line perpendicular thereto and extending in a direction toward said second edge of said laminate blank and having a second short score line in line with said first short score line and extending from said second edge toward said first short score line and a cut line connecting said first short score line and said second short score line;

a top plug inserted into the top of said cover member; and a bottom plug inserted into the bottom of said outer sleeve.

2. The hinged top box of claim 1 wherein said bottom plug has a top plate and a bottom plate defining an inner space therebetween.

3. The hinged top box of claim 2 wherein said top plate of said bottom plug is perforated.

4. The hinged top box of claim 3 wherein said top plate is covered with a permeable membrane.

5. The hinged top box of claim 1 wherein said bottom plug is perforated.

6. A hinged top box comprising:

an inner sleeve;

an outer sleeve formed from a laminate blank surrounding said inner sleeve;

a cover member formed from said laminate blank and connected to said outer sleeve by a flexual hinge;

said laminate blank defined by a first edge and a second edge, a first score line positioned adjacent to said first edge and extending in a direction toward said second edge, a second short score line in line with said first short score line and extending from said second edge toward said first short score line and a cut line connecting said first short score line and said second short score line;

a top plug inserted into the top of said cover member; and a bottom plug inserted into the bottom of said outer sleeve.

7. The hinged top box of claim 6 wherein said bottom plug has a top plate and a bottom plate defining an inner space therebetween.

8. The hinged top box of claim 7 wherein said top plate of said bottom plug is perforated.

9. The hinged top box of claim 8 wherein said top plate is covered with a permeable membrane.

10. A hinged top box comprising:

an inner sleeve formed from a laminate blank;

said laminate blank defined by a first edge and a second edge and a short score line extending from said second edge to define a flexual hinge;

a cover member connected to said inner sleeve by said flexual hinge;

an outer sleeve surrounding said inner sleeve;

a top plug inserted into the top of said cover member; and a bottom plug inserted into the bottom of said outer sleeve.

11. The hinged top box of claim 10 wherein said bottom plug has a top plate and a bottom plate defining an inner space therebetween.

12. The hinged top box of claim 11 wherein said top plate of said bottom plug is perforated.

13. The hinged top box of claim 12 wherein said top plate is covered with a permeable membrane.

* * * * *